US009352897B2

(12) United States Patent
Hoshino

(10) Patent No.: US 9,352,897 B2
(45) Date of Patent: May 31, 2016

(54) SQUEEZABLE CONTAINER

(71) Applicant: Shinya Hoshino, Tokyo (JP)

(72) Inventor: Shinya Hoshino, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/365,524

(22) PCT Filed: Dec. 18, 2012

(86) PCT No.: PCT/JP2012/082762

§ 371 (c)(1),
(2) Date: Jun. 13, 2014

(87) PCT Pub. No.: WO2013/099696

PCT Pub. Date: Jul. 4, 2013

(65) Prior Publication Data

US 2015/0001260 A1 Jan. 1, 2015

(30) Foreign Application Priority Data

Dec. 26, 2011 (JP) ..... 2011-283924
Jan. 27, 2012 (JP) ..... 2012-015382
Nov. 29, 2012 (JP) ..... 2012-261123

(51) Int. Cl.
*B65D 35/46* (2006.01)
*B65D 83/62* (2006.01)
(Continued)

(52) U.S. Cl.
CPC *B65D 83/62* (2013.01); *B65D 1/32* (2013.01); *B65D 23/02* (2013.01); *B65D 47/0804* (2013.01); *B65D 77/0486* (2013.01); *B65D 81/24* (2013.01); *B65D 83/48* (2013.01)

(58) Field of Classification Search
CPC ..... B65D 47/2018; B65D 47/2025; B65D 47/32; B65D 81/3216; B65D 83/0055; B65D 83/0061; B65D 83/48; B65D 83/62; B65D 23/02; B65D 47/0804; B65D 47/20; B65D 77/04; B65D 77/0486; B65D 81/24; B65D 83/34
USPC ..... 222/105, 107, 110, 111, 164, 212–21, 222/402.18, 402.21, 420–422, 481, 494, 222/571, 94–97
See application file for complete search history.

(56) References Cited

U.S. PATENT DOCUMENTS 5,190,190 A 3/1993 Fudalla
5,366,115 A * 11/1994 Kersten et al. ..... 222/105
(Continued)

FOREIGN PATENT DOCUMENTS

JP H0568852 U 9/1993
JP U-07-028055 5/1995
(Continued)

OTHER PUBLICATIONS

Feb. 12, 2013 International Preliminary Report on Patentability issued in International Application No. PCT/JP2012/082762.
(Continued)

*Primary Examiner* — Frederick C Nicolas
*Assistant Examiner* — Bob Zadeh
(74) *Attorney, Agent, or Firm* — Oliff PLC

(57) ABSTRACT

A squeezable container is provided with an outer container for forming the outer appearance of the container, and having a mouth/neck section; and an inner container for discharging the contents filling the interior of the inner container through the spout plug mounted to the mouth/neck section when the volume of the inner container is reduced by squeezing the body section of the outer container, and positioned on the inside of the outer container.

18 Claims, 9 Drawing Sheets

(51) Int. Cl.

| | |
|---|---|
| ***B65D 81/24*** | (2006.01) |
| ***B65D 83/48*** | (2006.01) |
| ***B65D 23/02*** | (2006.01) |
| ***B65D 77/04*** | (2006.01) |
| ***B65D 1/32*** | (2006.01) |
| ***B65D 47/08*** | (2006.01) |

(56) References Cited

U.S. PATENT DOCUMENTS

| | | | | |
|---|---|---|---|---|
| 5,454,486 | A | 10/1995 | Mack et al. | |
| 6,286,725 | B1 | 9/2001 | Gerber | |
| 6,672,479 | B2 * | 1/2004 | Shiraishi et al. | 222/105 |
| 2002/0130139 | A1 | 9/2002 | Shiraishi et al. | |
| 2003/0230596 | A1 | 12/2003 | Masuda | |
| 2004/0011810 | A1 * | 1/2004 | Mita et al. | 222/105 |
| 2006/0163282 | A1 * | 7/2006 | Suzuki | 222/135 |
| 2008/0041890 | A1 | 2/2008 | Masuda | |
| 2014/0144938 | A1 | 5/2014 | Kakuta et al. | |

FOREIGN PATENT DOCUMENTS

| | | | |
|---|---|---|---|
| JP | H1045180 | A | 2/1998 |
| JP | H10120054 | A | 5/1998 |
| JP | A-2000-041727 | | 2/2000 |
| JP | B2-3137850 | | 2/2001 |
| JP | A-2002-510372 | | 4/2002 |
| JP | A-2002-263166 | | 9/2002 |
| JP | 2002362611 | A | 12/2002 |
| JP | A-2003-012012 | | 1/2003 |
| JP | 2003072864 | A | 3/2003 |
| JP | A-2003-321048 | | 11/2003 |
| JP | A-2003-321074 | | 11/2003 |
| JP | A-2004-231280 | | 8/2004 |
| JP | 2011031938 | A | 2/2011 |
| JP | A-2012-192975 | | 10/2012 |
| JP | A-2013-014380 | | 1/2013 |
| WO | WO 2012/169489 | A1 | 12/2012 |

OTHER PUBLICATIONS

U.S. Appl. No. 14/124,012, filed Jan. 31, 2014.

Feb. 12, 2013 International Search Report issued in International Application No. PCT/JP2012/082762 (with translation).

Apr. 20, 2015 Search Report issued in European Application No. 12861150.6.

May 12, 2015 Office Action issued in Japanese Application No. 2012-015382.

Apr. 29, 2015 Office Action issued in U.S. Appl. No. 14/124,012.

* cited by examiner (a)

(b)

(a)

(b)

(a)

(b)

SQUEEZABLE CONTAINER

TECHNICAL FIELD

This invention relates to a squeezable container made from a synthetic resin and having an inner-outer double structure. Here, the inner-outer double structure includes both of a double container formed by assembling an inner container part filled with a content onto an inside of an outer container part and a delamination type container wherein an inner layer body filled with a content is separated from an inner wall face of an outer layer body to pour the content. Hereinafter, the part located at the inside is represented as an inner container part and the part located at the outside is represented as an outer container part.

RELATED ART

In the squeezable container, the content is poured by pushing a trunk portion of the outer container part to reduce a volume of the inner container part disposed at an inside thereof. Since an inner pressure is decreased associated with the pouring of the content, only the trunk portion of the outer container part is restored to an original form, for example, by taking ambient air into a space between the inner container part and the outer container part through an air hole formed in a side wall of a mouth part of the outer container part.

Recently, the container of this type is frequently used as a bottle for filling a hair dye, cosmetics, foods or the like in a wide field. From a viewpoint of attempting quality retention of the content (prevention on oxidation of content, sublimation of ingredients or the like), the container has a structure of disposing a valve body opening only in the pouring of the content in a pouring plug. For example, see JP-A-2003-12012.

In the conventional squeezable container, the valve body is returned to a blocked state immediately after the stop of the squeezing operation, so that the content is retained in a pathway ranging from the valve body to a pouring port of the pouring plug. Consequently, the retained content is flowed out by the posture of the container such as falling of the container or the like to cause liquid dripping, and hence there is a fear of contaminating a surrounding portion of the pouring port to provide unsanitary condition.

In order to solve such an inconvenience, Japanese Patent No. 3137850 proposes a structure of a non-return valve comprising a valve chamber with an intake port and a discharge port, a valve body reciprocating in the chamber and a valve seat contacting with an outer peripheral face of the valve body, wherein a cylindrical portion is formed in an upper part of the valve chamber and when the valve body is moved in the cylindrical portion downward, the valve body forms a blocking plug to divide a liquid in the valve chamber into an upper liquid and a lower liquid and a part of the upper liquid is sucked into the valve chamber by the movement of the valve body.

In the conventional non-return valve, however, a part of the upper liquid contacted with ambient air flows into the lower liquid during the movement of the valve body, so that there is still room for improvement in a point whether the quality of the content in the container can be maintained stably until the content is consumed completely.

SUMMARY OF THE INVENTION

Task to be Solved by the Invention

It is, therefore, an object of the present invention to propose a squeezable container capable of avoiding liquid dripping or the like associated with the retention of the content while preventing flow-in of the content contacted with ambient air in the container to maintain the quality of the content in the container.

Solution for Task

In order to solve the above task, a squeezable container in accordance with the present invention comprises an outer container part having a mouth/neck portion and forming an appearance of the container, and an inner container part disposed inside of the outer container part and pouring a content filled therein through a pouring plug mounted on the mouth/neck portion by squeezing a trunk portion of the outer container part for volume reduction wherein ambient air is introduced into a space between the outer container part and the inner container part through an opening hole formed in the outer container part in a recovering process of the trunk portion of the outer container part associated with the squeezing, and the container is characterized in that a partition wall blocking communication of the mouth/neck portion to a pouring hole is disposed between the mouth/neck portion of the inner container part and the pouring hole of the pouring plug, and a gate passing the content is disposed in the partition wall, and a valve body is disposed on the gate to open the gate by pushing through squeezing of the trunk portion of the outer container part to pass the content, and a reservoir for sucking back having an opening port passing through the partition wall and sucking and reserving the content retaining between the pouring hole and the partition wall in the recovering process of the trunk portion of the outer container part associated with the squeezing is disposed in the partition wall, and the reservoir comprises a main reservoir body forming a reserving space for the retained content in its inside and a movable body capable of moving toward approaching and separating directions with respect to the opening port in a housing space of the main reservoir body and sucking the retained content from the opening port into the housing space through movement toward separation from the opening port.

In the squeezable container of the present invention, it is especially preferable as a concrete means for the solution of task that the container comprises an outer container part having a cylindrical mouth/neck portion and forming an appearance of the container, an inner container part disposed inside the outer container part and pouring a content filled therein through a pouring plug mounted on the mouth/neck portion by squeezing a trunk portion of the outer container part for volume reduction, and an ambient air introducing valve introducing ambient air between the outer container part and the inner container part in the recovering process of the trunk portion of the outer container part associated with the squeezing through an ambient air introducing hole formed in the pouring plug and an opening hole formed in the mouth/neck portion of the outer container part.

Also, in the squeezable container of the present invention, it is especially preferable as a concrete means for the solution of task that the ambient air introducing valve comprises a cantilever support elastic tongue piece integrally connected at its base portion to the valve body on the gate and separating from an inner wall valve seat of the pouring plug in the recovering process of the trunk portion of the outer container part to open the air introducing hole, or that the ambient air introducing valve comprises a movable body, which blocks the ambient air introducing hole by matching with the ambient air introducing hole through tilting or reversing posture of the container or positive pressure generated between the outer container part and the inner container part while opens the ambient air introducing hole by separating from the ambient air introducing hole through negative pressure between the outer container part and the inner container part generated by normal posture of the container or recovering deformation of the outer container part, and at least two locking claws suspended downward along the edge portion of the ambient air introducing hole at the inner wall of the pouring plug to movably sandwich the movable body and introducing ambient air through a gap formed therebetween.

Further, in the squeezable container of the present invention, it is especially preferable as a concrete means for the solution of task that the reservoir is comprised of a main reservoir body held at a suspended state in the lower part of the partition wall to form a housing space for the retained content at the inside thereof, and a slider capable of moving toward approaching and separating directions to the opening port in the housing space of the main reservoir body and sucking the retained content through the opening port into the housing space through the movement in the separating direction from the opening port, or that the reservoir is comprised of a pathway having a cylindrical body arranged to an adjacent site of the partition wall forming the gate and a spherical valve body capable of moving from exit side to entry side of the cylindrical body, and sucking and reserving the content retained in the space between the pouring hole and the partition wall in the recovering process of the trunk portion of the outer container part after finishing the squeezing, or that three-point valve is used as the valve body on the gate.

Effect of the Invention

According to the squeezable container of the present invention having the above construction, the partition wall blocking the communication of the mouth/neck portion to the pouring hole is disposed between the mouth/neck portion of the inner container part and the pouring hole of the pouring plug, and the valve body capable of opening the gate formed in the partition wall by pushing associated with the squeezing of the trunk portion of the outer container part to pass the content is disposed in the partition wall, and the reservoir for sucking back having an opening port passing through the partition wall and sucking and reserving the content retaining between the pouring hole and the partition wall in the recovering process of the trunk portion of the outer container part associated with the squeezing is disposed in the partition wall, so that the retained content is sucked into the reservoir by the movement of the movable body after the stop of the squeezing operation, whereby liquid dripping due to discharge of the content from the pouring port can be avoided. Also, the retained content is not flown into the container through the gate, so that the content in the container can be maintained at a high quality till the end of consumption.

Also, according to the squeezable container of the present invention, the squeezable container is constructed with the outer container part having the cylindrical mouth/neck portion and forming the appearance of the container, the inner container part arranged inside the outer container part and pouring the content filled therein through the pouring plug mounted on the mouth/neck portion by the volume reduction through the squeezing of the trunk portion of the outer container part, and the ambient air introducing valve for introducing ambient air between the outer container part and the inner container part in the recovering process of the trunk portion of the outer container part associated with the squeezing through the ambient air introducing hole formed in the pouring plug and the opening hole formed in the mouth/neck portion of the outer container part, so that the outer container part can rapidly recover to the initial form even in the crushing through squeezing.

Also, according to the squeezable container of the present invention, the ambient air introducing valve comprises a cantilever support elastic tongue piece integrally connected at its base portion to the valve body on the gate and separating from an inner wall valve seat of the pouring plug in the recovering process of the trunk portion of the outer container part to open the ambient air introducing hole, so that the number of components parts can be reduced and the efficient assembling can be attained.

Also, according to the squeezable container of the present invention, the ambient air introducing valve comprises a movable body, which blocks the ambient air introducing hole by matching with the ambient air introducing hole through tilting or reversing posture of the container or positive pressure generated between the outer container part and the inner container part while opens the ambient air introducing hole by separating from the ambient air introducing hole through negative pressure between the outer container part and the inner container part generated by normal posture of the container or recovering deformation of the outer container part, and at least two locking claws suspended downward along the edge portion of the ambient air introducing hole at the inner wall of the pouring plug to movably sandwich the movable body and introducing ambient air through a gap formed therebetween, so that the opening and closing of the ambient air introducing valve can be made more surely.

Further, according to the squeezable container of the present invention, the reservoir is constructed with a main reservoir body held at a suspended state in the lower part of the partition wall to form a housing space for the retained content at the inside thereof, and a slider capable of moving toward approaching and separating directions to the opening port in the housing space of the main reservoir body and sucking the retained content through the opening port into the housing space through the movement in the separating direction from the opening port, so that the retained content can be sucked into the housing space by a simple construction.

Moreover, according to the squeezable container of the present invention, the reservoir is constructed with a penetration pathway having a cylindrical body arranged to an adjacent site of the partition wall forming the gate and a spherical valve body capable of moving from exit side to entry side of the cylindrical body, and sucking and reserving the retained content in the space between the pouring hole and the partition wall in the recovering process of the trunk portion of the outer container part after finishing the squeezing, so that the retained content can be sucked into the housing space by a simple construction.

Further, according to the squeezable container of the present invention, the three-point valve is used as the valve body on the gate passing the content, so that it is possible to surely block the pathway of the content, and penetration of ambient air, foreign matter or the like into the container can be avoided to maintain the quality of the content over a long period of the time.

BEST MODE FOR CARRYING OUT THE INVENTION

The present invention will be described more concretely with reference of the accompanying drawings.

Figure 1:
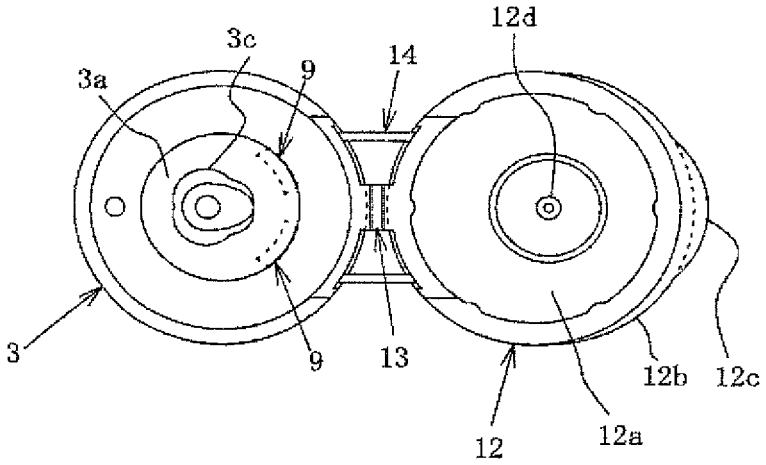
FIG. 1 is a view illustrating an embodiment of the squeezable container according to the present invention wherein (a) is a plane view and (b) is a side view in section.
Figure 1:
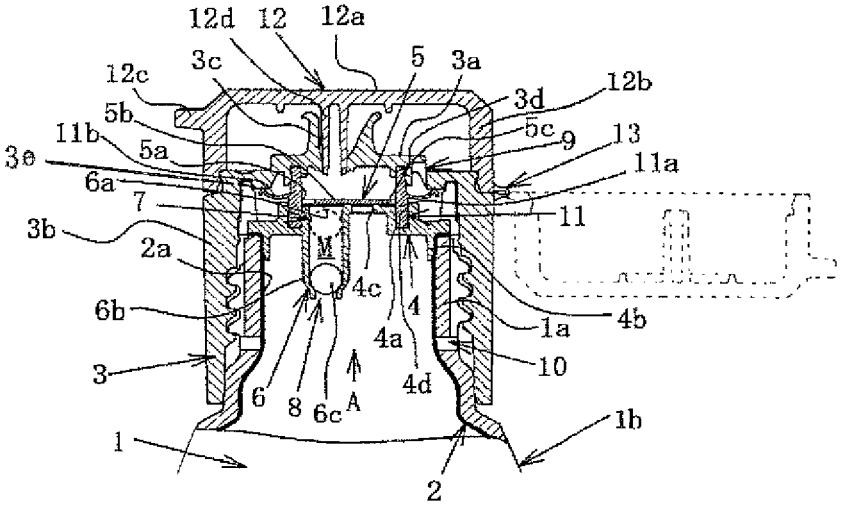
Figure 2:
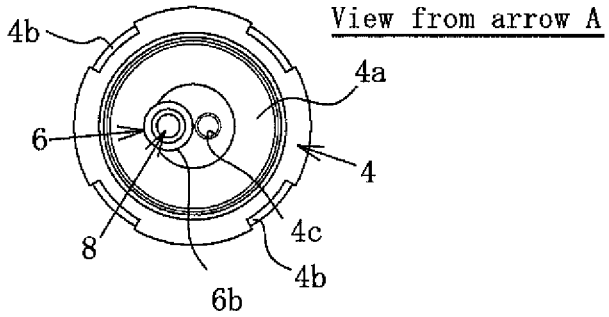
FIG. 2 is a view from an arrow A of FIG. 1.

FIGS. 1(*a*) and (*b*) are schematic views of an embodiment of the squeezable container (delamination type) according to the present invention, and FIG. 2 is a view from an arrow A of FIG. 1.

In these figures, numeral 1 represents an outer container part (outer layer body) made from a soft synthetic resin recoverable to an initial form and forming an appearance of the container. The outer container part 1 may have, for example, a bottle form having a cylindrical mouth/neck portion 1*a*. However, the form of a trunk portion 1*b* thereof may be variously changed in accordance with the kind and applications of the content, so that the full form of the outer container part 1 is not denoted here. Although the cylindrical form is shown as an example of the mouth/neck portion 1*a*, the form is not restricted to the cylinder, and various forms may be adopted properly.

Numeral 2 represents an inner container part (inner layer body) capable of reducing a volume by squeezing the trunk portion of the outer container part 1. In the inside of the inner container part 2 is formed a filling space, and a content is filled in the filling space. In the inner container part 2, a mouth/neck portion 2*a* is integrally connected to the mouth/neck portion 1*a* of the outer container part 1, and a narrow joint portion connecting to an inner wall of the outer container part 1 along a central axis of the container is disposed in at least one place of a circumference of its trunk portion, whereby the inner container part is positioned in the outer container part 1. Moreover, the joint portion is an adhesion site of non-delamination state, but the arrangement of the joint portion may be omitted.

Numeral 3 represents a pouring plug detachably mounted on the mouth/neck portion 1*a* of the outer container part 1 through screwing (which may also be fitted through undercutting). The pouring plug 3 comprises a top face wall 3*a* covering an opening port of the mouth/neck portion 1*a* of the outer container part 1, a ring-shaped peripheral wall 3*b* integrally connected to an edge portion of the top face wall 3*a* and provided at its inner wall face with a screw portion fitted with a screw portion formed in the outer periphery of the outer container part 1, and a pouring cylinder 3*c* disposed on the top face wall 3*a* and capable of pouring the content through a pouring hole.

Numeral 4 represents a disc-shaped partition wall disposed between a bottom of the top face wall 3*a* of the pouring plug 3 and the mouth/neck portion 1*a* of the outer container part 1. The partition wall 4 blocks communication between the mouth/neck portion 1*a* of the outer container part 1 and the pouring hole. At a lower face of a main partition wall body 4*a* covering the opening port of the mouth/neck portion 1*a* is disposed a leg portion 4*b* fitting with inner faces of the mouth/neck portion 2*a* of the inner container part 2 and the mouth/neck portion 1*a* of the outer container part 1, while a gate (opening hole) 4*c* passing the content is formed in the main partition wall body 4*a*.

Figure 3:
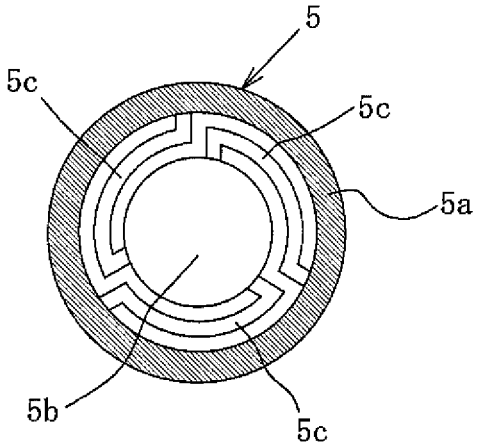
FIG. 3 is a view illustrating a construction of a three-point valve in the squeezable container of FIG. 1.

Numeral 5 represents a valve body disposed on the gate 4*c* and holding the gate 4*c* at a blocked state while opening the gate 4*c* by squeezing of the trunk portion of the outer container part 1 to pass the content. As the valve body 5 is used a three-point valve constructed, for example, with a tubular base portion 5*a* forming a fixed portion, a main valve body (portion blocking the gate 4*c*) 5*b* and three elastic arms 5*c* integrally joining the base portion 5*a* and the main valve body 5*b* as shown in FIG. 3. Moreover, the structure of the valve body 5 is not limited to the above.

Numeral 6 represents a reservoir for sucking back, which is disposed in a site adjacent to the gate 4*c* and has an opening port 6*a* passing through the partition wall 4. The reservoir 6 is constructed with a main reservoir body 6*b* made of a bottomless cylindrical peripheral wall holding pendant to the lower part of the partition wall 4 (which may be integrally connected to the partition wall 4 or may be combined with the other member, or may also be vertically stood on the upper part of the partition wall 4) and forming a housing space M for the retaining content therein, and a slider 6*c* as a movable body capable of moving in approaching and separating directions with respect to the opening port 6*a* in the housing space M of the main reservoir body 6*b* and sucking the retained content through the opening port 6*a* into the housing space M during the movement in a direction separating from the opening port 6*a*. Moreover, the opening port 6*a* may be partly covered with the valve body 5, but is not blocked completely and is always at an opened state.

Numeral 7 represents at least one projection disposed at an upper end site of the peripheral wall forming the main reservoir body 6*b* for preventing the slider 6*c* from getting out of the opening port 6*a*, and numeral 8 represents an end opening port formed in the lower part of the main reservoir body 6*b*. The size of the end opening port 8 is smaller than that of the slider 6*c*, so that the slider 6*c* moves between the projection 7 and the end opening port 8.

When the container is held at a tilting posture or an inverting posture in the pouring of the content, the slider 6*c* moves so as to approach most closely to the opening port 6*a*. On the other hand, when the container is returned to a normal posture to stop the pouring of the content is stopped and the container is returned to a normal posture, the slider 6*c* moves in a direction separating from the opening port 6*a* or moves toward the end opening port 8 by its own weight or a negative pressure generated by the recovering force of the inner container part 2. In this case, the retained content existing on the upper face of the partition wall 4 is sucked into the housing space M through the opening port 6*a* to avoid liquid dripping.

Although a slight gap may be formed between the slider 6*c* and the peripheral wall forming the main reservoir body 6*b*, the gap is set so as not to pass the retained content through the gap considering surface tension of the content or the like, so that the retained content is surely housed in the housing space M. As a result, the content contacted with ambient air (retained content) is avoided to suck into the container through the main reservoir body 6*b*.

The slider 6*c* may be made from a synthetic resin or a metal. Especially, in case of using the metallic slider, smooth movement is made possible by its own weight and the sucking back effect can be more enhanced. When the slider 6*c* is made from a metallic part, a surface thereof may be covered with a resin, whereby the quality of the content may be maintained stably.

In this embodiment, the slider 6*c* is shown as a spherical body, but the form thereof may be properly changed as long as it may be smoothly moved in the main reservoir body 6*b* and is not limited to the illustrated one. For example, it may be disc-like, cylindrical, prismatic or the like. Moreover, the slider 6*c* is designed so as not to substantially pass the content and/or air thereover.

Numeral 9 represents an ambient air introducing hole formed in at least one place (preferably two places) of the top face wall 3*a* of the pouring plug 3, and numeral 10 represents a lateral opening hole formed in the mouth/neck portion 1*a* of the outer container part 1. Ambient air flowing through the ambient air introducing hole 9 is introduced into a gap formed between an outer edge portion of the partition wall 4 and the ring-shaped peripheral wall 3*b* of the pouring plug 3 and a gap formed between the mouth/neck portion 1*a* and the ring-shaped peripheral wall 3*b* of the pouring plug 3 and between the inner container part 2 and the outer container part 1 through the opening hole 10.

Numeral 11 represents an ambient air introducing valve disposed and fixed between the pouring plug 3 and the partition wall 4. The ambient air introducing valve 11 is constructed with a cylindrical body 11*a* forming a compartment zone therein by fitting its upper end portion with the ring-shaped peripheral wall 3*d* disposed in the lower face of the top face wall 3*a* of the pouring plug 3 (disposed in a position surrounding the through-hole as a pouring hole of the pouring cylinder 3*c*) and fitting its lower end portion with the ring-shaped peripheral wall 4*d* disposed in the upper face of the partition wall 4 (disposed in a position surrounding the opening port 6*a*, gate 4*c* and valve body 5), and a ring-shaped elastic tongue piece 11*b* integrally connected to an outer peripheral wall of the cylindrical body 11*a* at a cantilevered state and contacting its free end with an inner wall valve seat portion 3*e* of the top face wall 3*a* of the pouring plug 3 at a separable state to hold the ambient air introducing hole 9 at a closed state.

The ambient air introducing valve 11 is opened when the outer container part 1 recovers an initial form by removing a force applied to the trunk portion of the outer container part 1 (force for squeezing). The outer container part 1 recovers the initial form immediately by introducing ambient air between the inner container part 2 and the outer container part 1. The ambient air introducing valve 11 is held at a blocked state when the inner container part 2 is pushed down by the squeezing operation, whereby the content filled in the inner container part 2 is discharged surely.

The ambient air introducing valve 11 may be integrally connected to the valve body 5 (combination of the base portion 5*a* of the valve body 5 with the cylindrical body 11*a*), whereby the number of the parts can be decreased. However, the cylindrical body 11*a* and the valve body 5 may be constituted with different members, which are not particularly limited.

Further, numeral 12 represents a cover body. The cover body 12 is openably and closably connected to an edge portion of the top face wall 3*a* of the pouring plug 3 through a hinge 13 and an elastic body 14. The cover body 12 comprises atop plate 12*a*, a peripheral wall 12*b* connecting to an edge portion of the top plate 12*a*, and a finger latching portion 12*c* integrally connecting to a front of the peripheral wall 12*b*. When the cover body 12 is closed, a ring-shaped body 12*d* disposed in the rear face of the top plate 12*a* is inserted and fitted into the pouring hole of the pouring cylinder 3*c*. In this case, at least a part of the retained content is sucked into the housing space M, so that the retained content is not existent in the pouring hole and liquid dripping or liquid splashing is never caused even if the ring-shaped body 12*d* is inserted into the pouring hole.

Figure 4:
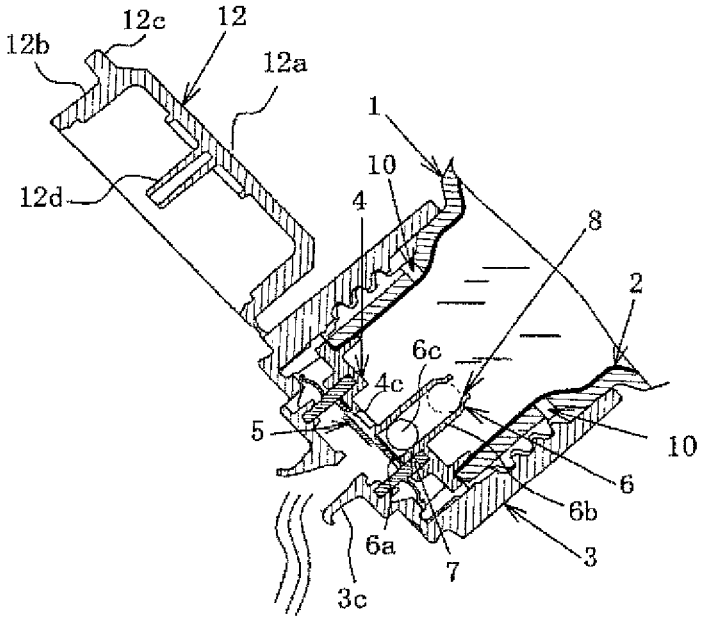
FIG. 4 is a view illustrating a pouring state of a content from the squeezable container of FIG. 1.

In the squeezable container having the above construction, in order to pour the content filled in the inner container part 2, the trunk portion of the outer container part 1 is sufficient to be squeezed while holding the container at the tilting posture or inversing posture as shown in FIG. 4, whereby the volume of the inner container part 2 is decreased (reduced in volume) and the content filled therein is discharged from the pouring hole of the pouring cylinder 3*c* through the mouth/neck portion 2*a* and gate 4*c*. In this case, the slider 6*c* is located in a position near to the opening port 6*a* (side forming the projection 7).

When the squeezing operation is stopped to release the pushed state, the gate 4*c* is immediately held at the blocked state by the valve body 5, while the elastic tongue piece 11*b* of the ambient air introducing valve 11 is separated from the inner wall valve seat portion of the pouring plug 3 to release the ambient air introducing hole 9, whereby ambient air is introduced between the outer container part 1 and inner container part 2 to rapidly recover the outer container part 1 to the initial form (form before crushing).

When the container is returned to a normal posture (standing posture) and the squeezing operation is stopped (released), the content is retained in a zone ranging from the pouring cylinder 3*c* to the partition wall 4, but the content retaining on the upper part of the partition wall 4 is sucked into the housing space M of the reservoir 6 by sucking back associated with the movement of the slider 6*c* during the moving of the slider 6*c* toward the end opening port 8.

The amount of the content sucked is determined by the moving distance of the slider 6*c* and the volume of the housing space M, which is properly set.

Moreover, the reservoir 6 may be disposed in the main valve body 5*b* of the valve body 5.

Figure 5:
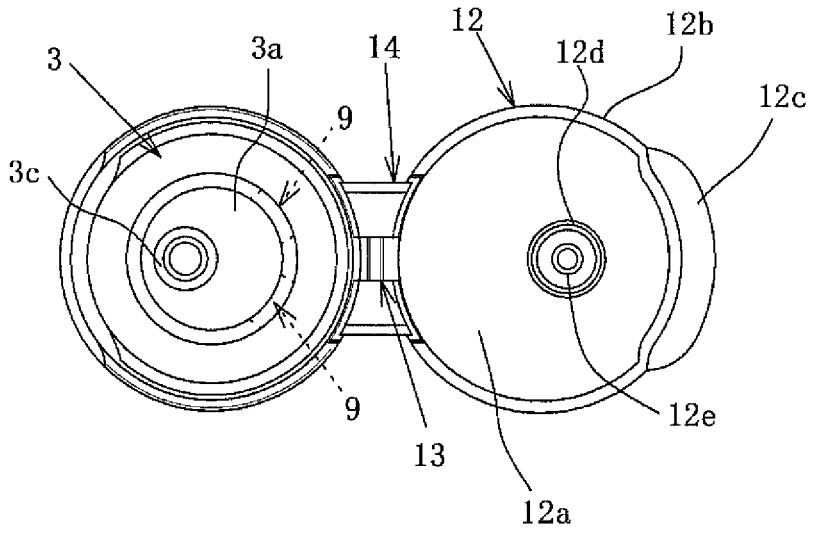
FIG. 5 is a view illustrating another embodiment of the squeezable container according to the present invention wherein (a) is a plane view and (b) is a side view in section.
Figure 5:
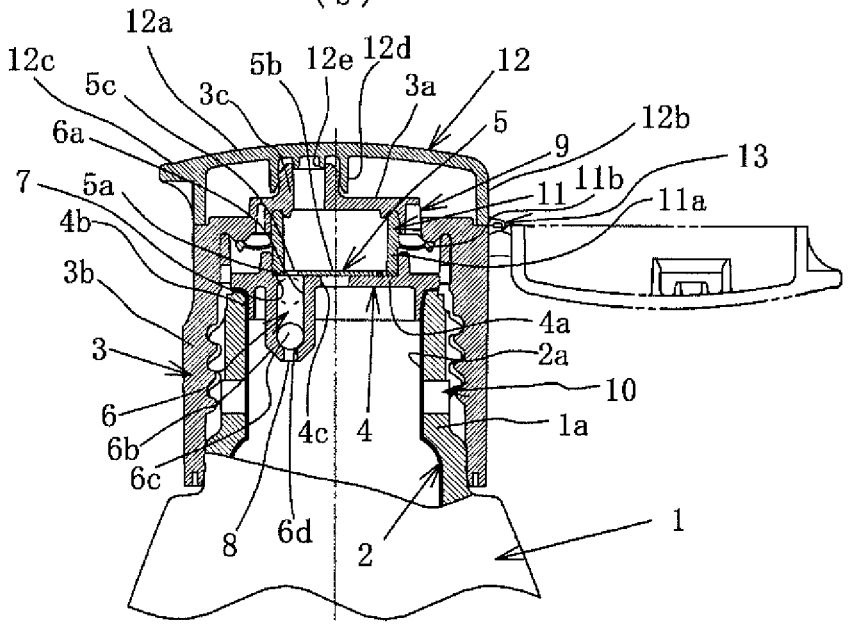

FIG. 5 is a view illustrating another embodiment of the squeezable container according to the present invention, wherein FIG. 5(*a*) is a plane view and FIG. 5(*b*) is a side view in section. Here, the same part as in the previous embodiment is represented by the same symbol.

The squeezable container embodied in FIG. 5 is mainly different from the previous embodiment in the point of forming a pathway 6 as the reservoir for sucking back and the structure of the cover body 12 and has the same construction as in the previous embodiment in the other points, so that only the different points will be described below.

Numeral 6 in this embodiment represents a penetration pathway formed adjacent to the gate 4*c* in the partition wall 4 as the reservoir for sucking back. The penetration pathway 6 is formed by a cylindrical body 6*b* as a main reservoir body integrally connected to the lower part of the partition wall 4, and is provided in its inside with a spherical valve body 6*c* as a movable body capable of freely moving between an exit side (lower end) opening port 8 at one end side of the penetration pathway 6 and an entrance side (upper end) opening port 6*a* at the other end side thereof in accordance with the posture of the container.

In the exit side opening port 8 of the penetration pathway 6 is formed an opening hole 6*d* with a size blocking the pathway 6 when the spherical valve body 6*c* is positioned therein, while at least one projection 7 is formed in the entrance side opening port 6*a* of the penetration pathway so as not to get out the spherical valve body 6*c*. The entrance side opening port 6*a* of the penetration pathway is opened to the partition wall 4.

The penetration pathway 6 has a function of sucking the content retained on the upper face of the partition wall 4 back into the penetration pathway 6 by the movement of the spherical valve body 6*c* when the spherical valve body 6*c* arrives, for example, from the entrance side opening port 6*a* at the exit side opening port 8 (when the content is poured, the posture of the container is obliquely downward or inverting posture, while the posture of the container becomes a normal posture after finishing the pouring of the content and hence the spherical valve body 6*c* moves from the entrance side opening port 6*a* to the exit side opening port 8) or so-called sucking back function, and hence it is possible to avoid liquid dripping.

Further, in the cover body 12 of this embodiment, when the cover body 12 is closed, a ring-shaped body 12*d* formed in the back face of the top plate 12*a* is fitted into an outside of the pouring cylinder 3*c*, and a ring-shaped body (which may be a convex) 12*e* located inside the ring-shaped body 12*d* is fitted into the through-hole (pouring hole) of the pouring cylinder 3*c*.

Figure 6:
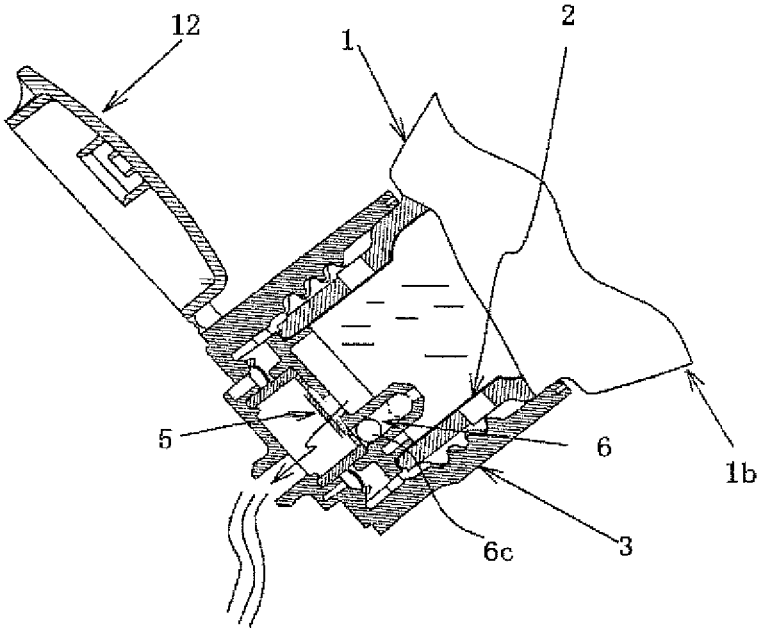
FIG. 6 is a view illustrating a pouring state of a content from the squeezable container of FIG. 5.

In the squeezable container having the above construction, in order to pour the content filled in the inner container part 2, the trunk portion of the outer container part 1 is sufficient to be squeezed while holding the container at the tilting posture or inverting posture as shown in FIG. 6, whereby the volume of the inner container part 2 is decreased (reduced in volume) and the content filled therein is discharged from the through-hole (pouring hole) of the pouring cylinder 3*c* through the mouth/neck portion 2*a* and gate 4*c*. In this case, the spherical valve body 6*c* is located in the entrance side opening port 6*a* of the penetration pathway 6.

When the squeezing operation is stopped to release the pushed state, the gate 4*c* is immediately held at the blocked state by the valve body 5, while the elastic tongue piece 11*b* of the ambient air introducing valve 11 is separated from the inner wall valve seat portion of the pouring plug 3 to release the ambient air introducing hole 9, whereby ambient air is introduced between the outer container part 1 and inner container part 2 to rapidly recover the outer container part 1 to the initial form (form before crushing).

When the container is returned to a normal posture (standing posture) while stopping (releasing) the squeezing operation, the content is retained in a zone ranging from the pouring cylinder 3*c* to the partition wall 4, but the content retaining on the upper part of the partition wall 4 is sucked into the penetration pathway 6 by sucking back associated with the movement of the spherical valve body 6*c* during the moving of the spherical valve body 6*c* from the entrance side opening port 6*a* of the penetration pathway 6 to the exit side opening port 8 thereof.

In this case, a part of the retained content sucked into the penetration pathway 6 may be returned to the container from the exit side opening port 8 through a gap between the cylindrical body 6*b* and the spherical valve body 6*c* in accordance with the kind of the retained content. However, the retained content may be returned to the container through the penetration pathway as long as the bad influence is not given to the quality of the content in the container.

The amount of the retained content sucked into the penetration pathway 6 and the amount returned to the container are determined by the moving distance of the spherical valve body 6*c* and the gap formed between the cylindrical body 6*b* and the spherical valve body 6*c*, which are properly set.

Moreover, the cylindrical body 6*b* forming the penetration pathway 6 may be formed in the main valve body 5*b* of the valve body 5, whereby the size of the pouring plug 3 in the radial direction can be compacted.

Figure 7:
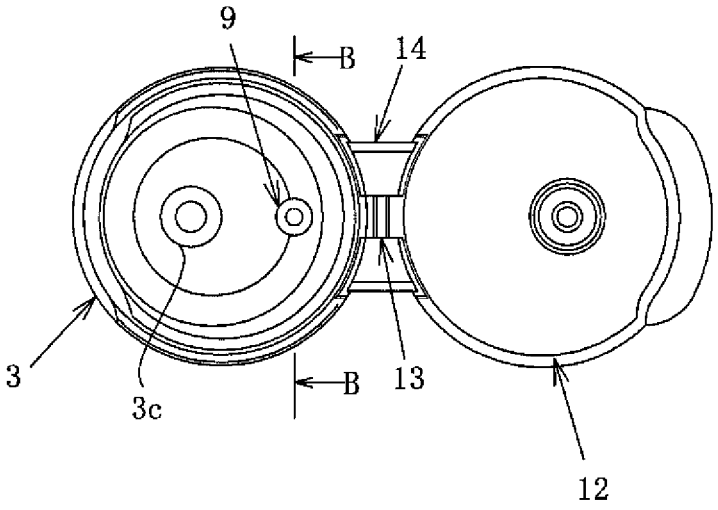
FIG. 7 is a view illustrating a further embodiment of the squeezable container according to the invention wherein (a) is a plane view and (b) is a side view in section.
Figure 7:
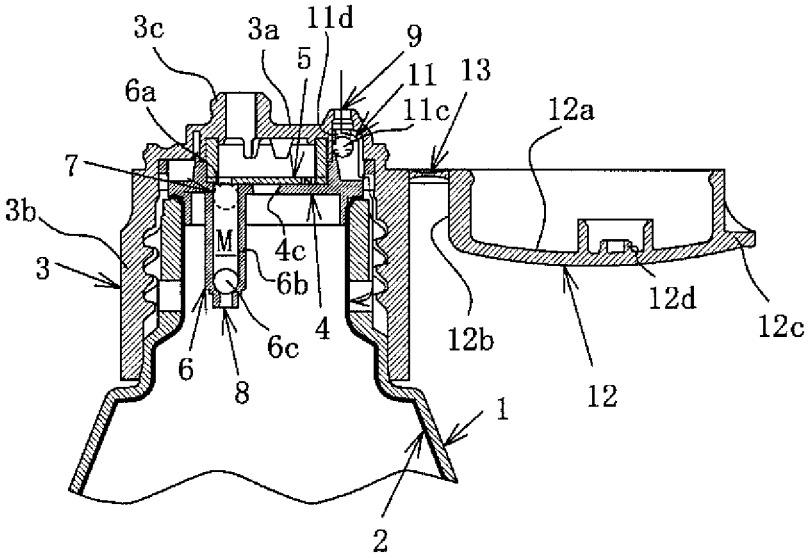
Figure 8:
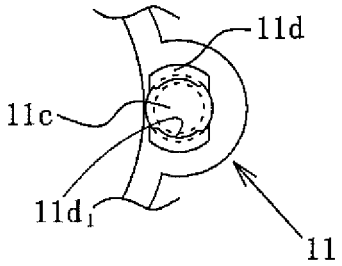
FIG. 8 is a bottom view illustrating a main part of an ambient air introducing valve in the squeezable container of FIG. 7.
Figure 9:
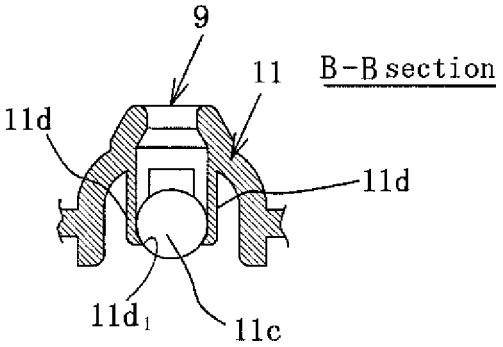
FIG. 9 is a view illustrating a main part in B-B section of FIG. 7(*a*).
Figure 10:
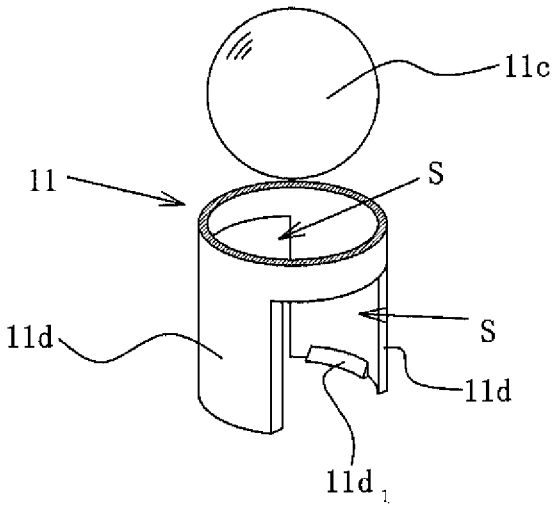
FIG. 10 is a perspective view of spherical body and locking pieces constituting an ambient air introducing valve in the squeezable container of FIG. 7.

FIGS. 7(*a*), 7(*b*), 8, 9 and 10 are views illustrating the further embodiment of the squeezable container according to the present invention. The same parts as in the previous embodiments are represented by the same symbols and the explanation thereof is omitted. In such a squeezable container, the ambient air introducing valve 11 is constructed with a spherical body 11*c* as a movable body closing the ambient air introducing hole 9 by matching with the ambient air introducing hole at the tilting, inversing posture of the container and opening the ambient air introducing hole 9 by separating from the ambient air introducing hole 9 at the normal posture of the container, and a pair of locking pieces 11*d* suspending down along the edge portion of the ambient air introducing hole 9 in the inner wall of the pouring plug 3 (back face of the top face wall 3*a*) and movably sandwiching the spherical body 11*c* to introduce ambient air through a gap S formed therebetween.

In the above ambient air introducing valve 11, the spherical body 11*c* is separated from the ambient air introducing hole 9 at a state that the container is a normal posture as shown in FIG. 7. In this case, it is possible to introduce ambient air between the outer container part 1 and the inner container part 2 through a path shown by an arrow in this figure.

Figure 11:
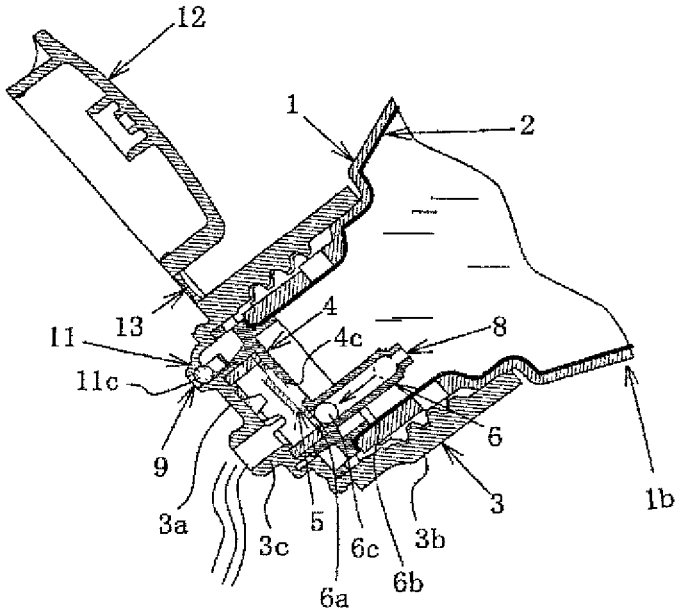
FIG. 11 is a view illustrating a pouring state of a content from the squeezable container of FIG. 7.

When the container is held at the tilting, inversing posture for pouring the content through squeezing as shown in FIG. 11, the spherical body 11*c* is moved along the locking pieces 11*d* and matched with the ambient air introducing hole 9 (contacted with the inner wall seat portion) to block the ambient air introducing hole 9, whereby force associated with the squeezing operation can be efficiently transferred to the inner container part 2 to surely crush the inner container part 2.

In the ambient air introducing valve 11 having the above construction, a claw portion $\mathbf{11}d_1$ as a locking claw is formed in a lower end of the locking piece 11*d*, whereby the spherical body 11*c* can be held for prevention from getting out. Alternatively, it is possible to hold the spherical body 11*c* for prevention from getting out by connecting the lower ends of the locking pieces 11*d* by a member such as rib or the like, which is not particularly limited. Also, the above is described to the arrangement of two locking pieces 11*d*, but three or more pieces may be arranged.

In FIGS. 1 to 11 is shown an example of the delamination type squeezable container wherein the outer container part 1 is an outer layer body and the inner container part 2 is an inner layer body and as the amount of the content poured is increased, the inner layer body is separated from the outer layer body 1 to decrease the volume thereof. However, the present invention is applicable to a double container formed by assembling the inner container part 2 filled with the content into the inside of the outer container part 1. Thus, it is possible to reuse the outer container part 1.

Also, in the above embodiments, the exit side (lower end) opening port 8 being one end side of the reservoir 6 is opened to the inner container part 2. In the present invention, however, a bottomed reservoir formed by closing the lower end side may be used.

Further, the reservoir of the present invention may be formed as a concave portion within a thickness range of the partition wall instead of the cylindrical form projected from the partition wall 4, or a plurality of the reservoirs may be arranged around the gate 4*c*.

INDUSTRIAL APPLICABILITY

According to the present invention, the content is not retained in the pouring plug of the squeezable container with a double structure, so that there is not caused leaking out of the content due to retaining or inconveniences resulted from the solidification of the content (clogging of pouring hole, poor operation of the valve body and the like). Also, the retained content is not flown into the container, so that the content in the container can be maintained in a high quality till the end of consumption.

DESCRIPTION OF REFERENCE SYMBOLS

1 outer container part
1*a* mouth/neck portion
2 inner container part
2*a* mouth/neck portion
3 pouring plug
3*a* top face wall
3*b* ring-shaped peripheral wall
3*c* pouring cylinder
3*d* ring-shaped peripheral wall
4 partition wall
4*a* main partition wall body
4*b* ring-shaped body
4*c* gate
4*d* ring-shaped peripheral wall
5 valve body
5*a* base portion
5*b* main valve body
6 reservoir (penetration pathway)
6*a* opening port
6*b* main reservoir body (cylindrical body)
6*c* movable body (slider, spherical valve body)
6*d* opening hole
7 projection
8 opening port
9 ambient air introducing hole
10 opening hole
11 ambient air introducing valve
11*a* cylindrical body
11*b* elastic tongue piece
11*c* movable body (spherical body)
11*d* locking piece
11$d_1$ claw portion
12 cover body
12*a* top plate
12*b* peripheral wall
12*c* finger latching portion
12*d* ring-shaped body
12*e* ring-shaped body
13 hinge
14 elastic body
M housing space
S gap

The invention claimed is:

1. A squeezable container comprising:

an outer container part having a mouth/neck portion and forming an appearance of the container;

an inner container part disposed inside of the outer container part;

a pouring plug mounted on the mouth/neck portion, the inner container part being configured to pour a content filled therein through the pouring plug by squeezing a trunk portion of the outer container part for volume reduction;

an opening hole formed in the outer container part, the opening hole being configured to introduce ambient air into a space between the outer container part and the inner container part through the opening hole in a recovering process of the trunk portion of the outer container part associated with the squeezing;

a partition wall disposed between the mouth/neck portion of the inner container part and a pouring hole of the pouring plug, the partition wall being configured to block communication of the mouth/neck portion to the pouring hole;

an opening disposed in the partition wall, the opening being configured to pass the content;

a valve body disposed on the opening, the valve body being configured to be pushed through squeezing of the trunk portion of the outer container part to open the opening to pass the content from the inner container part; and a reservoir disposed in the partition wall and having an opening port passing through the partition wall, the reservoir being configured to suck back and reserve the content retained between the pouring hole and the partition wall in the recovering process of the trunk portion of the outer container part associated with the squeezing, wherein the reservoir comprises (i) a main reservoir body forming a housing space for the retained content reserved in the reservoir and (ii) a movable body configured to move in approaching and separating directions with respect to the opening port in the housing space of the main reservoir body and suck the retained content from the opening port into the housing space through movement toward separation from the opening port.

2. The squeezable container according to claim 1, wherein the mouth/neck portion of the outer container part is cylindrical, the squeezable container further comprising an ambient air introducing valve configured to introduce ambient air between the outer container part and the inner container part in the recovering process of the trunk portion of the outer container part associated with the squeezing through an ambient air introducing hole formed in the pouring plug and the opening hole formed in the mouth/neck portion of the outer container part.

3. The squeezable container according to claim 2, wherein the ambient air introducing valve comprises a cantilever support elastic tongue piece, a base portion of the cantilever support elastic tongue piece being integrally connected to the valve body on the opening and separating from an inner wall valve seat of the pouring plug in the recovering process of the trunk portion of the outer container part to open the air introducing hole.

4. The squeezable container according to claim 3, wherein the reservoir is comprised of a main reservoir body held at a suspended state in a lower part of the partition wall to form the housing space for the retained content at an inside thereof, and a slider capable of moving in approaching and separating directions relative to the opening port in the housing space of the main reservoir body and sucking the retained content through the opening port into the housing space through the movement in the separating direction from the opening port.

5. The squeezable container according to claim 3, wherein the reservoir is comprised of a penetration pathway having a cylindrical body arranged to an adjacent site of the partition wall forming the opening and a spherical valve body capable of moving from exit side to entry side of the cylindrical body and sucking and reserving the content retained in the space between the pouring hole and the partition wall in the recovering process of the trunk portion of the outer container part after finishing the squeezing.

6. The squeezable container according to claim 3, wherein the valve body on the opening is a three-point valve.

7. The squeezable container according to claim 2, wherein the ambient air introducing valve comprises:

a movable body, which (i) blocks the ambient air introducing hole by matching with the ambient air introducing hole through tilting or reversing posture of the container or positive pressure generated between the outer container part and the inner container part, and (ii) opens the ambient air introducing hole by separating from the ambient air introducing hole through negative pressure between the outer container part and the inner container part generated by normal posture of the container or recovering deformation of the outer container part, and at least two locking claws suspended downward along an edge portion of the ambient air introducing hole at an inner wall of the pouring plug to movably sandwich the movable body and introducing ambient air through a gap formed therebetween.

8. The squeezable container according to claim 7, wherein the reservoir is comprised of a main reservoir body held at a suspended state in a lower part of the partition wall to form the housing space for the retained content at inside thereof, and a slider capable of moving in approaching and separating directions relative to the opening port in the housing space of the main reservoir body and sucking the retained content through the opening port into the housing space through the movement in the separating direction from the opening port.

9. The squeezable container according to claim 7, wherein the reservoir is comprised of a penetration pathway having a cylindrical body arranged to an adjacent site of the partition wall forming the opening and a spherical valve body capable of moving from exit side to entry side of the cylindrical body and sucking and reserving the content retained in the space between the pouring hole and the partition wall in the recovering process of the trunk portion of the outer container part after finishing the squeezing.

10. The squeezable container according to claim 7, wherein the valve body on the opening is a three-point valve.

11. The squeezable container according to claim 2, wherein the reservoir is comprised of a main reservoir body held at a suspended state in a lower part of the partition wall to form the housing space for the retained content at an inside thereof, and a slider capable of moving in approaching and separating directions relative to the opening port in the housing space of the main reservoir body and sucking the retained content through the opening port into the housing space through the movement in the separating direction from the opening port.

12. The squeezable container according to claim 11, wherein the valve body on the opening is a three-point valve.

13. The squeezable container according to claim 2, wherein the reservoir is comprised of a penetration pathway having a cylindrical body arranged to an adjacent site of the partition wall forming the opening and a spherical valve body capable of moving from exit side to entry side of the cylindrical body and sucking and reserving the content retained in the space between the pouring hole and the partition wall in the recovering process of the trunk portion of the outer container part after finishing the squeezing.

14. The squeezable container according to claim 2, wherein the valve body on the opening is a three-point valve.

15. The squeezable container according to claim 1, wherein the reservoir is comprised of a main reservoir body held at a suspended state in a lower part of the partition wall to form the housing space for the retained content at an inside thereof, and a slider capable of moving in approaching and separating directions relative to the opening port in the housing space of the main reservoir body and sucking the retained content through the opening port into the housing space through the movement in the separating direction from the opening port.

16. The squeezable container according to claim 15, wherein the valve body on the opening is a three-point valve.

17. The squeezable container according to claim 1, wherein the reservoir is comprised of a penetration pathway having a cylindrical body arranged to an adjacent site of the partition wall forming the opening and a spherical valve body capable of moving from exit side to entry side of the cylindrical body and sucking and reserving the content retained in the space between the pouring hole and the partition wall in the recovering process of the trunk portion of the outer container part after finishing the squeezing.

18. The squeezable container according to claim 1, wherein the valve body on the opening is a three-point valve.

* * * * *